US005951130A

United States Patent [19]

Braunschweig et al.

[11] Patent Number: 5,951,130

[45] Date of Patent: Sep. 14, 1999

[54] MOUNTING ARRANGEMENT FOR STACKED APPLIANCES

[75] Inventors: James R. Braunschweig, Colfax; Daniel F. Wunderlich; Thomas C. Magilton, both of Newton, all of Iowa

[73] Assignee: Maytag Corporation, Newton, Iowa

[21] Appl. No.: 08/947,766

[22] Filed: Oct. 9, 1997

[51] Int. Cl.[6] ..... A47B 43/00

[52] U.S. Cl. ..... 312/257.1; 248/639; 68/13 R

[58] Field of Search ..... 248/639, 672, 248/673; 312/198, 263, 257.1, 111, 108, 107, 228; 220/4.26, 4.02, 4.27; 68/3 R, 13 R

[56] References Cited

U.S. PATENT DOCUMENTS

| | | | |
|---|---|---|---|
| 1,226,708 | 5/1917 | Sellers | 312/107 |
| 2,833,137 | 5/1958 | Geldhof | 68/19 |
| 2,834,121 | 5/1958 | Geldhof | 34/75 |
| 2,843,943 | 7/1958 | Geldhof | 34/75 |
| 3,139,744 | 7/1964 | Alstyne | 68/20 |
| 3,220,229 | 11/1965 | Livesay | 68/19 |
| 3,545,235 | 12/1970 | Menk | 68/19.2 |
| 3,824,813 | 7/1974 | Davis | 68/12 R |
| 4,507,942 | 4/1985 | Hirose | 68/20 |
| 4,551,996 | 11/1985 | Hirose | 68/20 |
| 4,663,948 | 5/1987 | Rummel | 68/12 R |
| 4,680,948 | 7/1987 | Rummell | 68/3 R |
| 4,821,535 | 4/1989 | Wassilak et al. | 68/3 R |
| 4,972,687 | 11/1990 | Czech et al. | 68/3 R |
| 4,989,426 | 2/1991 | Kretchman | 68/3 R |
| 5,469,961 | 11/1995 | Chang | 220/23.6 |
| 5,653,416 | 8/1997 | Frank | 312/107 |

FOREIGN PATENT DOCUMENTS

| | | | |
|---|---|---|---|
| 222407 | 3/1958 | Australia . | |
| 2672962 | 8/1992 | France | 312/107 |
| 431854 | 9/1967 | Switzerland | 312/198 |

*Primary Examiner*—Peter M. Cuomo
*Assistant Examiner*—Gerald A. Anderson
*Attorney, Agent, or Firm*—Zarley, McKee, Thomte, Voorhees & Sease

[57] ABSTRACT

A stacked appliance assembly includes a lower unit, such as a clothes washing machine, and an upper unit, such as a clothes dryer. A support member is secured on top of the lower unit within the perimeter thereof. A base member is secured to the bottom of the upper unit within the perimeter thereof. The base member of the upper unit is adapted to slide upon the support member of the lower unit and to be secured thereto without the use of external mounting brackets. The support member and base member mounting arrangement provides automatic self-centered alignment of the upper unit on the lower unit. A plurality of tabs on the support member of the lower unit are received within slots on the base member of the upper unit so as to interlock the units together.

16 Claims, 4 Drawing Sheets

20
56
18
54
62
60
64
88
58
58A
62A
64A
52
82
80
72
74
75

MOUNTING ARRANGEMENT FOR STACKED APPLIANCES

BACKGROUND OF THE INVENTION

Stacked appliances, such as a clothes washer and dryer, are common in houses and buildings where space is limited, such as in apartments. In conventional stacked appliances, the upper unit, usually the dryer, is set upon the lower unit and brackets are attached to the backs of the units to secure them together. The interconnected stacked units are then slid into position against a wall or into an alcove.

Several problems exist with such conventional mounting arrangement for stacked appliances. First, the weight of the interconnected appliances makes it more difficult to move the stacked units into position against the wall or in the alcove, as compared to moving only one of the units into position. Secondly, accessibility to the backs of the units is limited, thus making hook-ups with the dryer vent, electricity, and gas more complicated.

Accordingly, a primary objective of the present invention is the provision of an improved mounting arrangement for stacked appliances.

Another objective of the present invention is the provision of a mounting arrangement for stacked appliances which allows quick and easy mounting of the upper unit on the lower unit.

A further objective of the present invention is the provision of stacked appliances wherein the upper unit is slideable on the lower unit and automatically aligned and interconnected.

Still another objective of the present invention is the provision of a mounting arrangement for stacked appliances which allows the lower unit to be positioned against a wall or into an alcove, make utility connections and then slidably position and secure the upper unit onto the lower unit.

Another objective of the present invention is the provision of a method for mounting an upper appliance unit onto a lower appliance unit to form a stable stacked set in a quick and simple manner.

These and other objectives will become apparent from the following description of the invention.

SUMMARY OF THE INVENTION

An improved mounting arrangement is provided for upper and lower appliance units which are stacked one upon the other. A support member extends along the sides and rear of the upper surface of the lower unit and a base member extends at least along the sides and rear portion of the bottom of the upper unit. The base member is adapted to slide into retentive engagement with the support member. The support member has a plurality of tabs which are received in slots on the base member, such that the upper and lower units are secured together. The tabs have angled edges which facilitate alignment of the upper unit on the lower unit. Downwardly extending projections on the base member substantially prevent lateral movement as the upper unit is slid rearwardly upon the lower unit. Brackets are provided adjacent the front of the upper and lower units to lock the units against relative movement.

BRIEF DESCRIPTION OF THE DRAWINGS

FIG. 6 is a top plan view of the assembled support and base members.

DETAILED DESCRIPTION OF THE DRAWINGS

Figure 1:
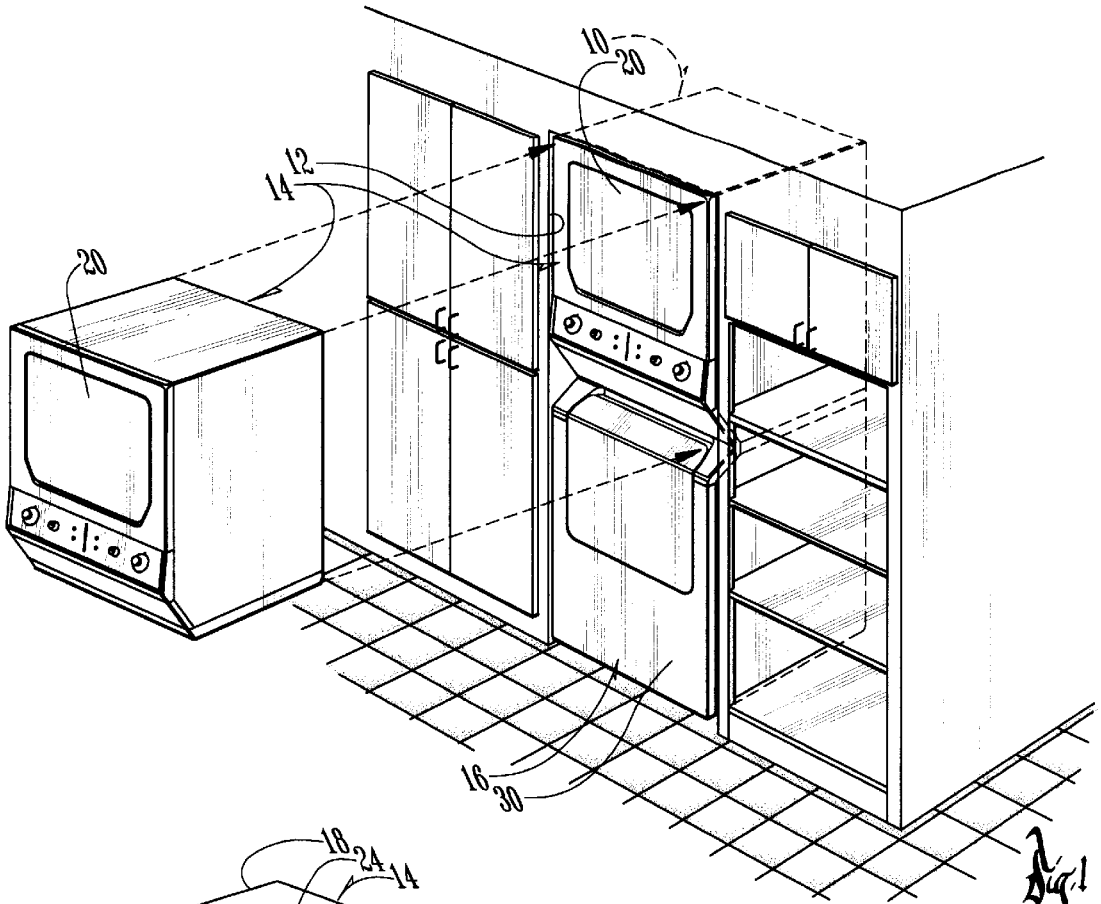
FIG. 1 is a schematic perspective view showing stacked appliances installed in an alcove.

In the drawings, the reference numeral 10 generally designates a stacked appliance assembly installed in an alcove 12 of a utility room. More particularly, the assembly 10 includes an upper unit 14 and a lower unit 16. While the drawings show the upper unit to be a clothes dryer and the lower unit to be a clothes washer, it is understood that either of the units may be another type of appliance.

The upper unit 14 includes opposite sides 18, a front 20, a back 22, a top 24, and a bottom 26. Similarly, the lower unit 16 includes opposite sides 28, a front 30, a back 32, a top 34, and a bottom 36.

Figure 2:
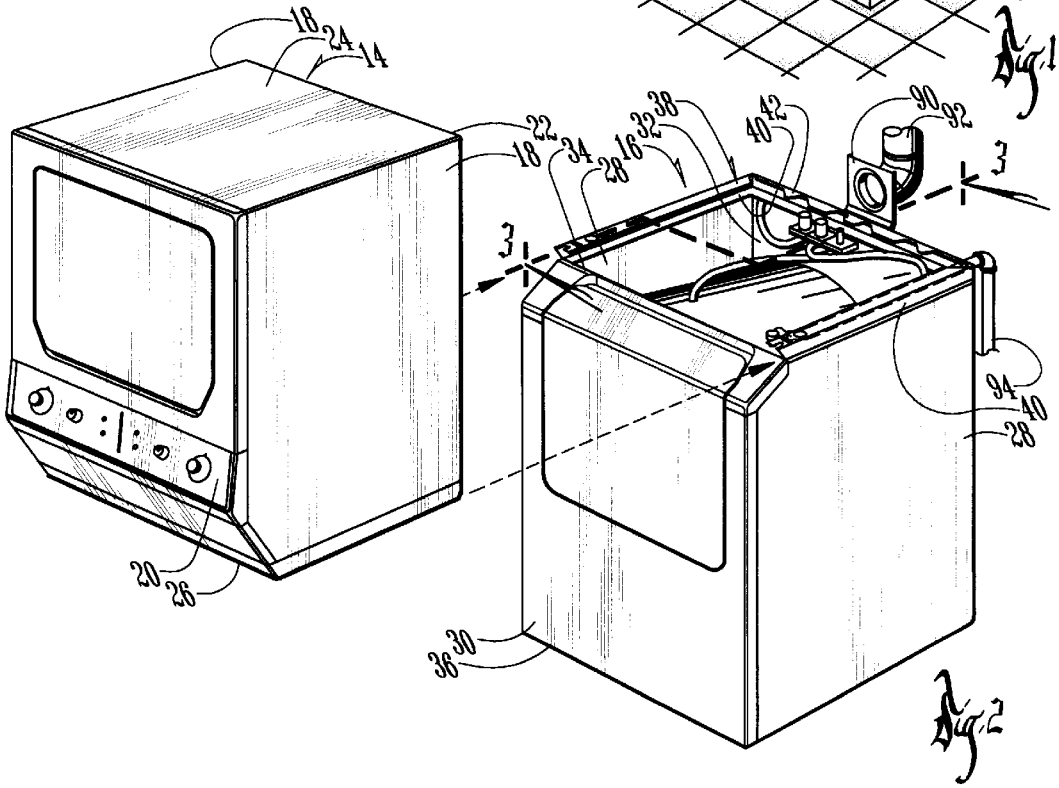
FIG. 2 is an exploded perspective view of the upper and lower units before assembly.

A support member 38 extends around the perimeter of the top 34 of the lower unit 16, as best seen in FIG. 2. Preferably, the support member 38 includes opposite side rails 40 and a back rail 42. The rails 40, 42 have a C-shaped cross section including a lower leg 44, an upper leg 46 and an interconnecting web 48. The support member 38 is secured to the top 34 of the lower unit 16 by a plurality of screws 50 extending through the lower leg 44 of the rails 40, 42, as best shown in FIG. 3.

A base member 52 is attached to the bottom 26 of the upper unit 14. As shown in the drawings, the base member 52 is in the form of a plate having upstanding perimeter walls 54 so as to cover the bottom 26 of the upper unit 14. Threaded or threadable bosses 56 are provided adjacent the corners of the base member 52 for receiving screws (not shown) to mount the base member 52 to the upper unit 14.

The back rail 42 of the support member 38 includes a plurality of tabs 58. The drawings show three tabs 58, though more or less tabs may be utilized. The tabs 58 include oppositely angled edges 60 which facilitate self-alignment of the upper unit 14 upon the lower unit 16, as described below. As seen in FIG. 6, the center tab 58A has a wider forward edge 62A than the forward edges 62 of the other tabs 58. The base member 52 includes a plurality of slots 64 to receive the tabs 58 such that the support member 38 and base member 52 overlappingly interlock with one another. The edges 61 of center tab 58A are in close proximity to the edges 64A of center slot 64 so that center tab 58A and center slot 64 cooperate to effectively center the base member 62 on the support member 38. The forward edge 66 of the slot 64 has a 90° downward bend so as to better enable it to slide under center tab 58A and help prevent misassembly, as best seen in FIG. 3.

Figure 3:
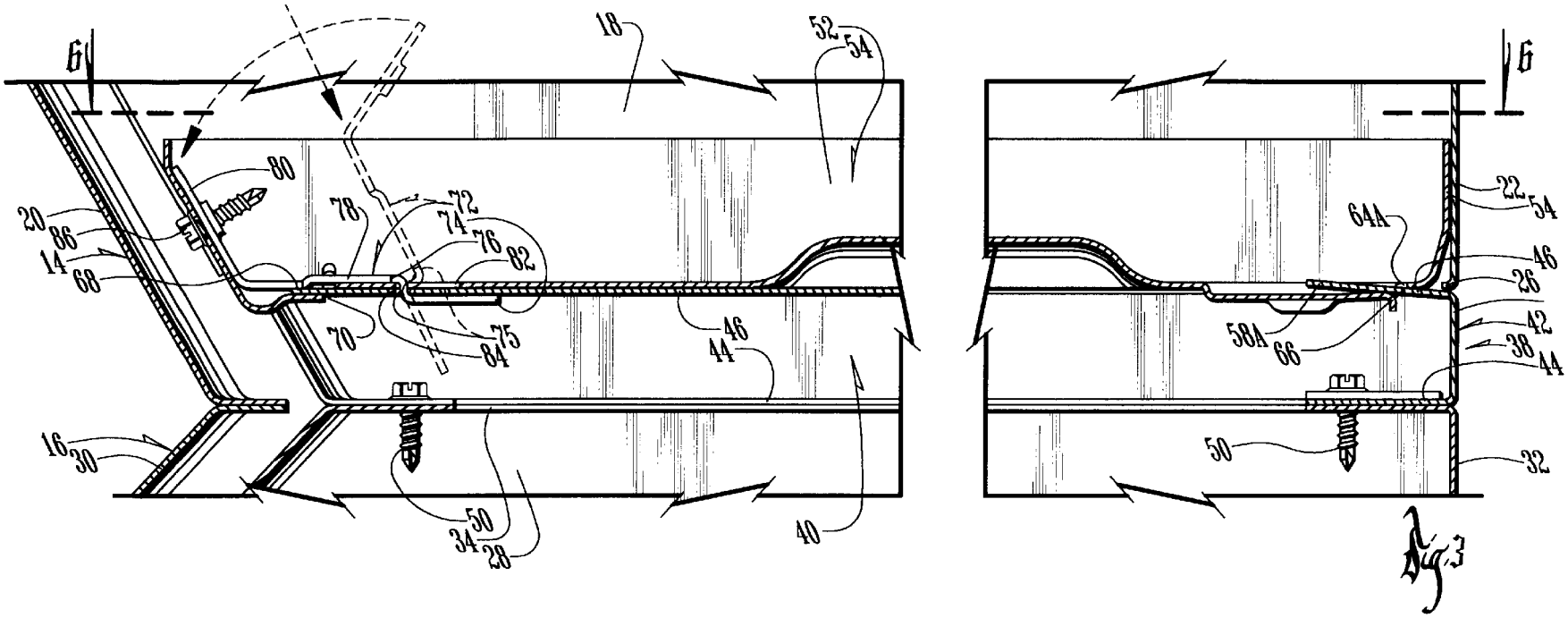
FIG. 3 is a partial sectional view taken generally along lines 3—3 of FIG. 2 showing the assembled support member of the lower unit and base member of the upper unit.
Figure 4:
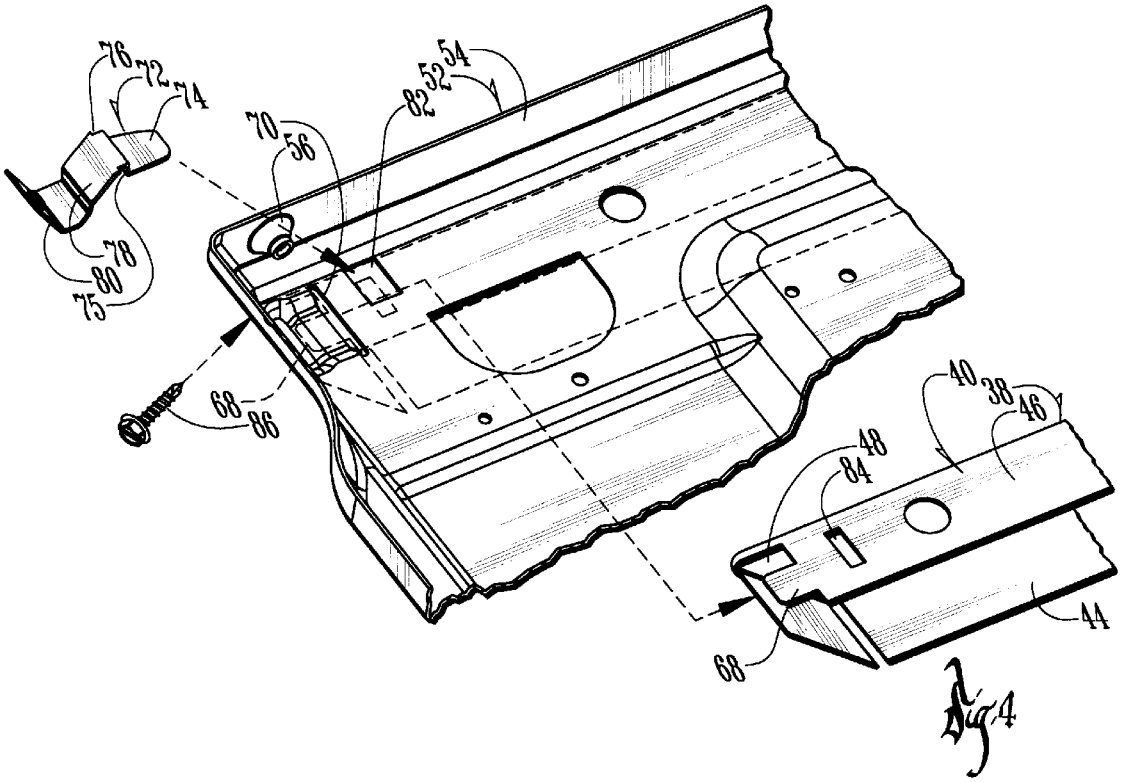
FIG. 4 is a partial perspective exploded view of a front corner of the support and base members.
Figure 5:
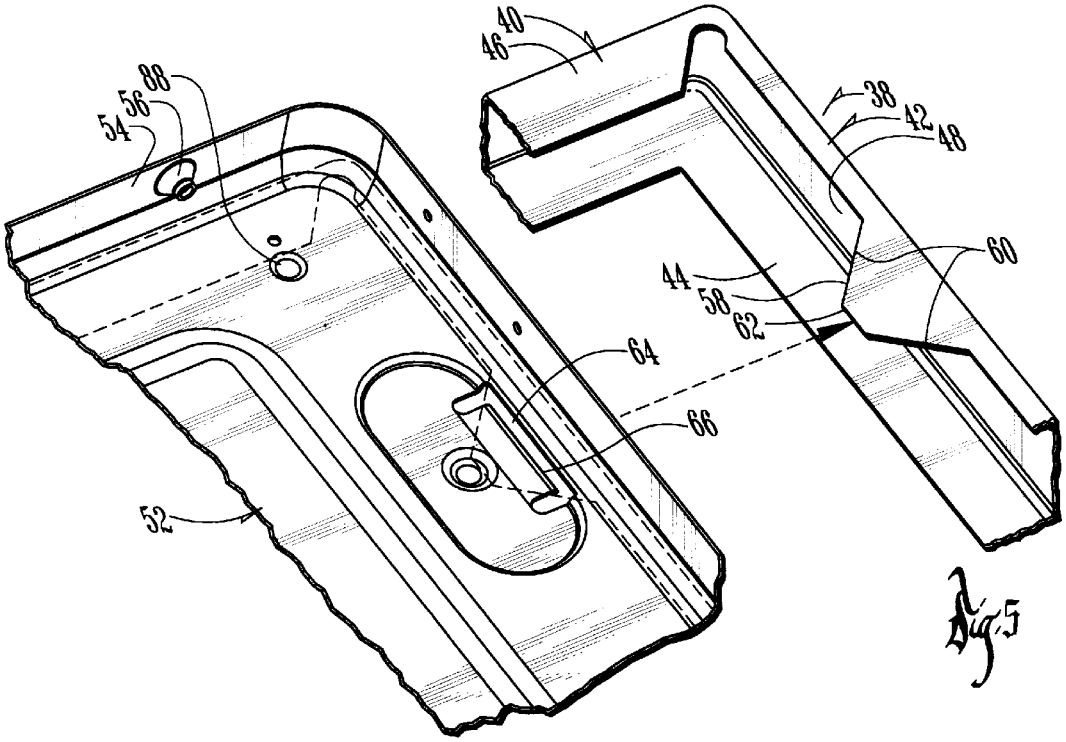
FIG. 5 is a partial perspective exploded view of a rear corner of the support and base members.
Figure 4:
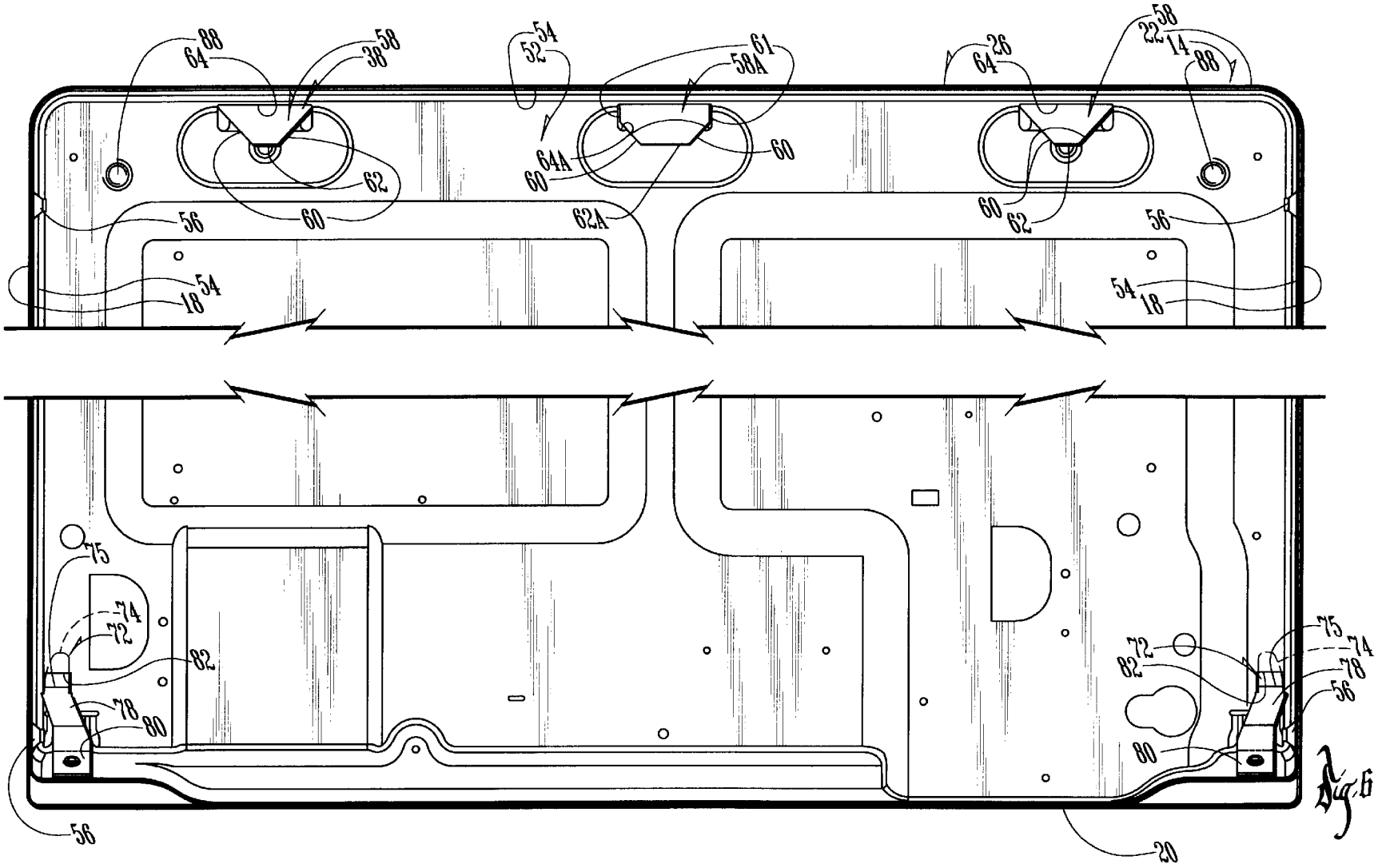

A tab 68 extends forwardly from each side rail 40 of the support member 38 adjacent the front of the rail 40, as best seen in FIGS. 3 and 4. The tab 68 is received through a slot 70 in the base member 52 as the upper unit 14 is slid rearwardly upon the lower unit 16.

A clip or bracket 72 includes a rear leg 74, a step 75, a raised shoulder 76, a central portion 78, and an upwardly angled front leg 80. The rear leg 74 is adapted to extend through aligned slots 82, 84 in the upper unit 14 and lower unit 16, respectively. The front leg 80 is secured to the front wall 54 of the base member 52 by a screw 86. The step 75 of the bracket 72 prevents relative forward or rearward movement between the support member 38 and the base member 52 after the screw 86 is threaded in place. The step 75 of the bracket 72 engages the slot 84 of the support member 38 so as to move the base member 52 rearwardly as the screw 86 is tightened.

The base member 52 includes a downwardly extending projection 88 adjacent each rearward corner. The projection 88 tracks along the upper leg 46 of the side rails 40 of the support member 38 as the base member 52 is slid rearwardly, thereby guiding and substantially preventing lateral movement between the base member 52 and the support member 38 before the rear tabs 58 of the support member 38 engage the slots 64 of the base member 52. The projections 88 may be integrally formed with the base member 52 or may be separately formed and attached thereto.

In assembling the upper and lower units 14, 16 into the stacked assembly 10, the lower unit 16 is first positioned in the alcove 12 with the electrical and gas, if provided, hookups being completed. Also, as seen in FIG. 2, if the upper unit 14 is a dryer, the lower unit 16 is provided with an upstanding bracket 90 to which an exhaust vent 92 is connected before the upper unit 14 is in place.

Then, the upper unit 14 is set onto the lower unit 16 such that the base member 52 rests upon the support member 38. The upper unit 14 is slid rearwardly along the support member 38, with lateral guidance from the projections 88. As the tabs 58 of the support member 38 begin to enter the slots 64 of the base member 52, the upper unit 14 will automatically align or self-center upon the lower unit 16 due to the angled edges 60 of the tabs 58. The center tab 58A can engage the center slot of the base member 52 briefly before the remaining tabs 58 engage the corresponding slots 64, due to the greater width of the tab 58A. As the rearward movement of the upper unit 14 upon the lower unit 16 continues, the front tabs 68 of the support member 38 will enter the slots 70 of the base member 52. Then, the rear legs 74 of the brackets 72 can be inserted through the aligned slots 82, 84 of the base member 52 and support member 38, respectively. Then the screw 86 can be inserted through the front wall 54 of the base member 52 and the correspondingly angled front leg 80 of the bracket 72, as best seen in FIG. 3, such that the step 75 will prevent relative forward movement between the upper unit 14 and the lower unit 16.

With the mounting arrangement of the present invention, it is unnecessary to provide external mounting brackets to secure the upper and lower units together, as in conventional prior art stacked appliances.

As the upper unit 14 is slid into position on the lower unit 16, the exhaust opening of the upper unit is automatically aligned and coupled to the exhaust bracket 90 of the lower unit. Also, the electrical connections (not shown) of the upper unit 14 are provided adjacent the front panel for quick and easy attachment to an electrical coupling (not shown) adjacent the front of the lower unit. A gas line 94, if provided, extends within the C-shaped side rail 40 to a location adjacent the front of the lower unit for quick and easy coupling to the upper unit 14, after the upper unit is positioned on the lower unit.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed:

1. An improved mounting arrangement for a stacked clothes washer and dryer assembly, including an upper appliance unit with a lower surface having a perimeter edge and a lower appliance unit having an upper surface with a perimeter edge, the mounting arrangement comprising:

a first support member connected to and extending along a portion of the perimeter edge of one of the units;

a second support member connected to and extending along a portion of the perimeter edge of the other of the units; and one of the first and second support members being adapted to slide into retentive engagement with the other support member, with portions of the first and second support members overlappingly interlocking with one another such that the first and second support members jointly support the upper unit on the lower unit.

2. The mounting arrangement of claim 1 wherein the first support member comprises a C-shaped channel extending along a portion of the perimeter edge of the lower unit and the second support member comprises a base extending along a portion of the perimeter edge of the upper unit.

3. The mounting arrangement of claim 2 wherein the portion of the first support member is at least one tab and the portion of the second support member is a slot for receiving the tab so as to secure the first support member to the second support member.

4. The mounting arrangement of claim 3 wherein the tab has angled side edges to provide self-alignment of the upper unit on the lower unit.

5. The mounting arrangement of claim 3 wherein the tab is adjacent a rear edge of the first support member.

6. The mounting arrangement of claim 3 wherein the tab is adjacent a front side of the first support member.

7. The mounting arrangement of claim 2 further comprising at least one bracket securable to the base and interlocking with the channel.

8. The mounting arrangement of claim 1 wherein the first support member is U-shaped with an open front side so as to extend along opposite sides and back of the perimeter edge.

9. The mounting arrangement of claim 2 wherein the base has a downwardly extending projection on each side to guide rearward sliding movement of the base on the channel.

10. The mounting arrangement of claim 1 wherein the support member on the upper unit is substantially flush with the lower surface thereof.

11. A stacked clothes washer and dryer assembly comprising:

a lower unit having opposite side walls, a rear wall and a front wall defining a perimeter;

an upper unit having opposite side walls, a rear wall, and a front wall, defining a perimeter;

a support member secured on top of the lower unit within the perimeter thereof;

a base member secured to the bottom of the upper unit and within the perimeter of the upper unit;

the upper unit being adapted to slide upon the lower unit and be secured thereto free from connecting brackets external to the perimeter of the units; and the support member and the base member jointly supporting the upper unit on the lower unit.

12. The stacked appliance assembly of claim 11 wherein the base member is recessed within the walls of the upper unit.

13. The stacked appliance assembly of claim 11 further comprising at least one bracket secured to the base and support members within the perimeters of the upper and lower units.

14. The stacked appliance assembly of claim 11 wherein the base member includes downwardly extending guides to prevent excessive lateral movement between the upper and lower units during sliding.

15. A stacked appliance assembly of claim 11 wherein the base member and support member having interlocking portions for securing the units together.

16. The stacked appliance assembly of claim 15 wherein the interlocking portions are self-centering.

* * * * *